United States Patent [19]

Goncalves

[11] Patent Number: 4,632,240

[45] Date of Patent: Dec. 30, 1986

[54] ASSEMBLY FOR THE PACKAGING AND APPLICATION OF A VARNISH-TYPE SUBSTANCE

[75] Inventor: Antonin L. Goncalves, Groslay, France

[73] Assignee: L'Oreal, Paris, France

[21] Appl. No.: 645,157

[22] Filed: Aug. 28, 1984

[30] Foreign Application Priority Data

Sep. 12, 1983 [FR] France ..... 83 14476

[51] Int. Cl.[4] ..... A45D 44/18

[52] U.S. Cl. ..... 206/15.2; 215/228; 215/341; 215/343; 401/129

[58] Field of Search ..... 215/228, 321, 331, 332, 215/343, 341, 350; 206/15.2; 401/120, 129, 4, 128; 366/247, 309

[56] References Cited

U.S. PATENT DOCUMENTS

| | | | |
|---|---|---|---|
| 2,096,975 | 10/1937 | Revson | 206/15.2 |
| 2,952,374 | 9/1960 | Pryale | 215/331 |
| 3,115,664 | 12/1963 | Del Ponte | 366/247 |
| 3,160,269 | 12/1964 | Davidson | 206/15.2 |
| 3,189,169 | 6/1965 | Davidson | 206/15.2 |
| 3,209,387 | 10/1965 | Lukesch | 206/15.2 |
| 3,438,530 | 4/1969 | Wallace | 215/341 |
| 3,986,626 | 10/1976 | Montgomery | 215/321 |
| 4,128,184 | 12/1978 | Northup | 215/350 |
| 4,230,230 | 10/1980 | Mumford | 215/321 |
| 4,238,042 | 12/1980 | Hatakeyama et al. | 215/341 |
| 4,289,248 | 9/1981 | Lynn | 215/331 |

FOREIGN PATENT DOCUMENTS

| | | | |
|---|---|---|---|
| 1432191 | 11/1968 | Fed. Rep. of Germany | 215/228 |
| 1418477 | 10/1965 | France . | |
| 2514327 | 10/1981 | France . | |
| 465158 | 12/1968 | Switzerland . | |
| 768195 | 2/1957 | United Kingdom . | |
| 904908 | 9/1962 | United Kingdom . | |
| 1459859 | 12/1976 | United Kingdom | 215/228 |

*Primary Examiner*—Joseph Man-Fu Moy
*Assistant Examiner*—David T. Fidei
*Attorney, Agent, or Firm*—Cushman, Darby & Cushman

[57] ABSTRACT

An assembly for packaging a volatile substance such as nail varnish comprises a bottle, a cap which may be non-cylindrical, and an applicator able to be catch-engaged in the cap. The applicator is provided with a resilient wall portion for yieldably connecting a sealing collar, preferably carrying the applicator, for example a brush, to the cap. Thus manufacturing tolerances of the cap and the bottle may be accommodated by the yielding of the resilient wall portion as the cap is screwed down onto the bottle neck.

14 Claims, 5 Drawing Figures

ASSEMBLY FOR THE PACKAGING AND APPLICATION OF A VARNISH-TYPE SUBSTANCE

BACKGROUND OF THE INVENTION

The present invention relates to a receptacle intended to enclose a volatile substance or one including volatile components, such as a varnish and particularly a nail varnish, this receptacle being provided with a removable stoppering device carrying a stem ending in an applicator brush for applying the substance.

The conventional device for closing a bottle of nail varnish consists of a stopper formed by a screw cap intended to cooperate with the threaded neck of the bottle; the said cap is covered by a decorative cover which is fixed integrally to it at the time of the assembly in a factory. The cap carries internally a stem arranged along its axis and ending in the applicator brush. This stem carries, at its end opposite that carrying the brush, a collar intended to bear on the upper annular edge of the neck of the bottle when the cap is in an assembled position on the latter, in order to ensure leaktight sealing of the closure.

In the manufacture of these receptacles and their stoppers on an industrial scale, some variation in the dimensions of the bottle and of the cap has to be permitted with the result that, for the same series of receptacles, the leakproof bearing of the collar on the neck of the bottle is not always obtained at the same angular position of the cover relative to the neck. These differences, which are due to manufacturing tolerances, become inconvenient particularly in the case where the cover has a non-cylindrical outer skirt which must, when screwed down, occupy a perfectly defined angular position relative to the bottle in order to give the assembly the required aesthetic appearance.

In the case just mentioned above, it is also observed that in the course of the repeated screwing and unscrewing carried out by the user, the angular positioning of the cover relative to the bottle changes as a result of repeated tightening, which is also detrimental to the required aesthetic presentation.

SUMMARY OF THE INVENTION

The present invention makes it possible to remedy these disadvantages. To this end, it provides resilient means ensuring, when the bottle is closed, the bearing of the collar on the edge of the neck of the bottle, these means being designed so as to make it possible to take up the differences due to the tolerances in the manufacture of the applicator stopper and of the closure cap. In this manner, when the cover has to adopt, on being screwed down, a determined angular position relative to the bottle, it is possible, without inconvenience, to provide for one end of the cap thread to bear against a corresponding end stop carried by the neck, or a similar locating means. Given that the collar is continually pressed against the edge of the neck by the abovementioned resilient means, it is certain that the leaktight sealing of the closure will always be ensured in the position at the end of the screwing. It is possible, of course, to attain the same result if the assembly of the cap on the neck is carried out other than by screwing.

The present invention therefore provides an assembly for the packaging and application of a volatile substance or a substance including volatile components, the said assembly incorporating:

(a) a storage container which encloses the said substance;

(b) a removable closure device which is assembled on the storage container; and (c) an applicator fixed to the closure device and entering with its lower part into the storage container when the closure device is assembled on the storage container, the said applicator carrying a collar intended to come to bear on the upper edge of the storage container in the above-mentioned assembly position in order to ensure the leaktight sealing of the closure;

wherein the collar is, in the said assembly position, pushed against the upper edge of the storage container by resilient means.

According to a first embodiment of the present invention, the resilient means consist of a wall joining the collar to the closure device.

In this case, the wall joining the collar to the closure device is advantageously made in two parts of which the first part, adjust to the said collar, is capable of being resiliently distorted between the collar and the second part, and the said second part carries means which are complementary to corresponding means carried by the closure device with a view to fixing the applicator closure device.

Preferably, the first part of the wall connecting the collar to the closure device widens out from the collar outwards in the shape of a conical frustum.

The second part of the wall connecting the collar to the closure device is preferably substantially perpendicular to the collar. In this case, the said second part advantageously incorporates, in the region of its free edge, catching means which are complementary to corresponding means carried by the closure device. For example, the catching means of the second part of the wall consist of a peripheral catching bead cooperating with a peripheral catching bead of a complementary shape carried by the closure device.

Advantageously, the second part of the abovementioned wall is cylindrical and the closure device incorporates an inner wall, also cylindrical, arranged facing the said second part of the wall, at least in the region of the edge of the latter, one of the surfaces facing the said closure device and the said second part of the wall incorporating means for holding against the other surface, preventing the rotation of the applicator relative to the closure device. These holding means consist, for example, of a peripheral bead carried externally by the second part of the wall, the said bead coming to bear against the inner wall facing the closure device.

According to other characteristics of the abovementioned assembly, the closure device incorporates a lateral wall provided with means for assembly, which are complementary to corresponding means carried by the storage container, with a view to assembling said closure device on the said storage container, the said means for assembly advantageously consisting of two complementary threads carried respectively by the closure device and the storage container and preferably shaped so as to provide a screwing action over approximately a quarter of a turn; means are provided for ensuring the angular positioning of the closure device on the storage container when these two components are assembled together, the said means advantageously comprising, in the case of assembly by screwing, at least one end stop carried externally by the storage container, above the threaded region of the said storage container, and arranged so that, on screwing down, the end of a thread of the closure device situated at the start of the said thread bears against the abovementioned end stop; means are provided to prevent the loosening of the closure device assembled on the storage container, the said means advantageously consisting of a retaining groove carried by the inner wall of the closure device, the said groove being capable of catching, when assembly is completed, on a bead carried by the storage container; the collar ensuring leaktight sealing on the upper edge of the storage container incorporates a seal-bead intended to bear on the said edge; and the applicator consists of a stem the lower end of which carries an applicator brush, the collar ensuring leaktight sealing on the upper edge of the storage container being carried by the upper end of the stem.

According to a second embodiment of the assembly according to the invention, the resilient means are carried by a cap forming a connection between the closure device and the applicator, the applicator being capable of sliding relative to the cap under the action of the resilient means.

To make the subject of the present invention better understood, a description will be given below, by way of purely illustrative and non-limiting example, of an embodiment shown in the attached drawing.

DESCRIPTION OF THE PREFERRED EMBODIMENTS

Figure 1:
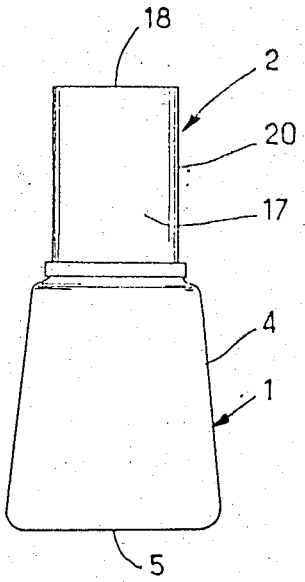
FIG. 1 is an elevation view of a bottle of nail varnish closed by the closure device according to the invention.
Figure 2:
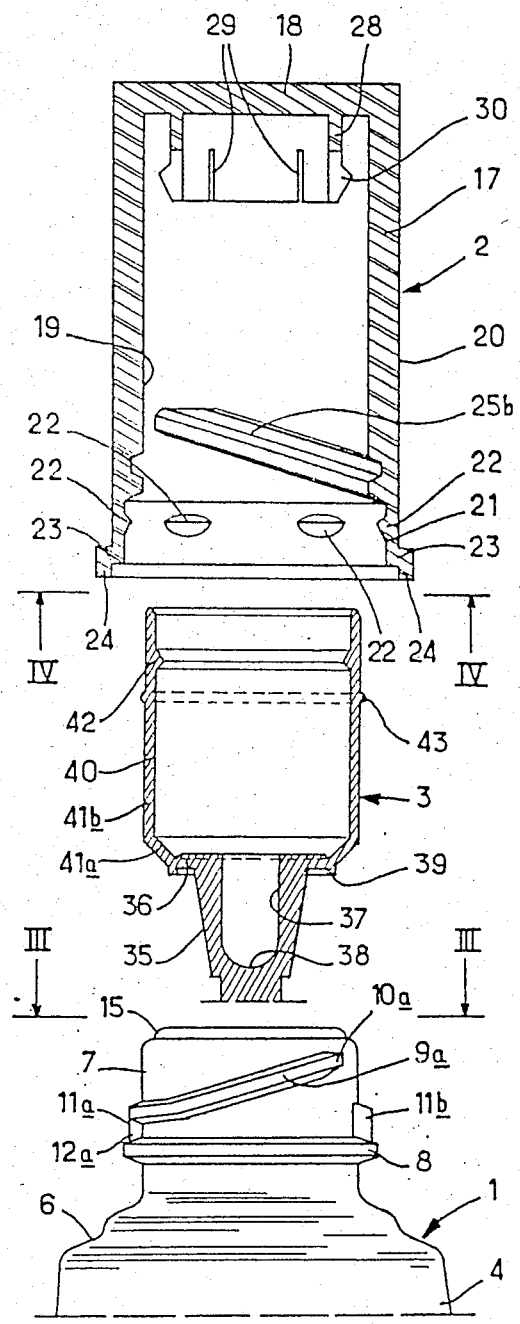
FIG. 2 is an exploded view of the upper part of the bottle and its closure device, the bottle being shown in elevation and the closure device in axial section.
Figure 3:
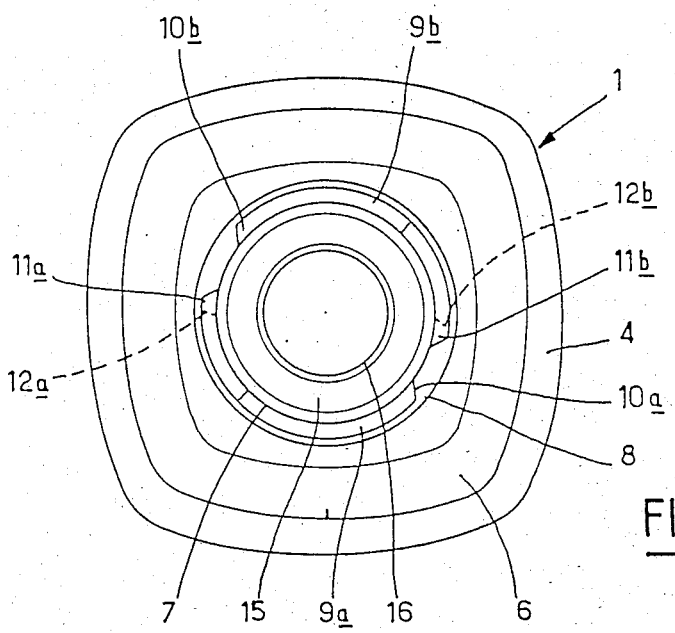
FIG. 3 is a top view of the bottle without its closure device, taken along III—III of FIG. 2.

With reference to the drawing, it can be seen that 1 indicates a storage container which consists of a glass bottle of small capacity intended to enclose a nail varnish. The bottle 1 is associated with a closure device 2 and an applicator device 3.

The bottle 1 has a body 4, of substantially square cross-section which narrows from the bottom 5 up to an upper wall 6 which is connected to a central cylindrical neck 7. At rhe base of the neck is a peripheral rib 8 of substantially trapezoidal cross-section, above which there is a threading with two threads 9*a*, 9*b*, of substantially trapezoidal cross-section. The length of each of the two threads 9*a* and 9*b* is equal to three eighths of a turn. The start 10*a*, 10*b* of each of the two threads 9*a*, 9*b*, incorporates an initial section, that is to say a short section of thread of progressively increasing cross-section. The ends of the two threads 9*a*, 9*b*, situated at the start 10*a*, 10*b* of each said threads are diametrically opposite. The pitch of each thread over a quarter of a turn starting from the end situated at the start 10*a*, 10*b*, of each thread 9*a*, 9*b*, is greater than the pitch of the same thread over the remaining region, the length of which is equal to an eighth of a turn.

The grooves arranged between the two threads 9*a*, 9*b*, and the rib 8 terminate respectively in an end stop 11*a*, 11*b*, which ends on the peripheral rib 8, the two end stops 11*a*, 11*b*, being diametrically opposite and each incorporating a radial face 12*a*, 12*b*, terminating in the true sense of the term the grooves arranged below the corresponding threads 9*a*, 9*b*. These two faces 12*a*, 12*b*, are arranged in the same radial plane passing through the axis of the neck 7.

Above the region of the threading 9*a*, 9*b*, the neck 7 has an inward bend 13 (FIG. 5) which defines the outlet orifice 14 of the bottle 1 and the upper edge of which 15 forms an annular bearing on which bear the sealing means described later. The inner edge 16 of the orifice 14 (FIG. 5) is bevelled so as to facilitate the entry of applicator means described later.

The closure device 2, made of a relatively rigid moulded plastic such as polypropylene, consists of a skirt 17 connected to a bottom 18.

Figure 4:
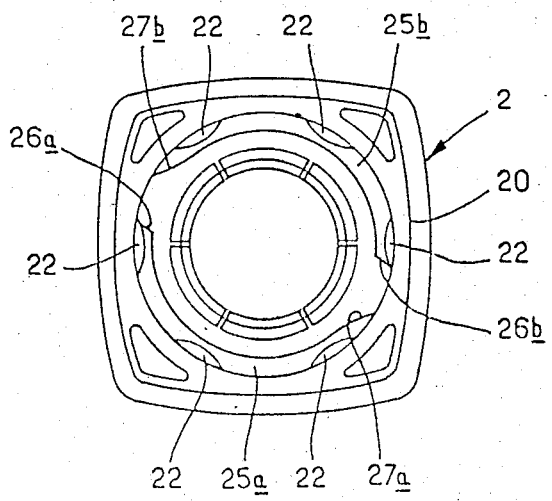
FIG. 4 is a bottom view of the cover as such of the closure device, taken along IV—IV of FIG. 2.

The skirt 17 has a cylindrical inner wall 19 and an outer wall 20 which, as can be seen in FIG. 4, has a cross-section, in the direction at right angles to its axis, which is in the shape of a square the sides of which are slightly bulged outwards.

In the neighbourhood of its free edge, the skirt 17 is of lower thickness; the region 21 of the lowest thickness carries internally a non-continuous peripheral groove which is defined by six regularly distributed projections 22; the projections 22 are intended to catch, in the assembled position of the device 2 on the bottle 1, under the peripheral bead 8 provided on the neck 7.

Figure 5:
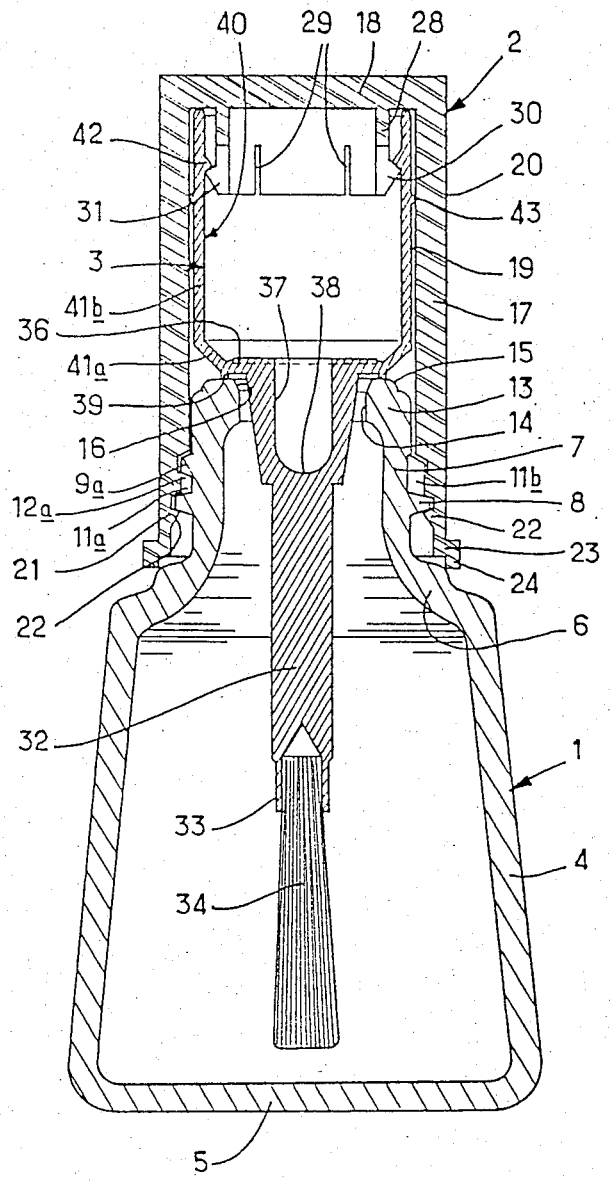
FIG. 5 is a view in axial section of the entire bottle closed by its closure device.

Furthermore, the skirt 17 has, along its free edge, two right-angled returns, the first 23, which is directed outwards and the second 24, which is located in the extension of the skirt 17. In the assembly position of the device 2 on the bottle 1, the inner edge of the return 24 bears against the upper wall 6 of the neck 1, as can be seen in FIG. 5.

Above the groove defined by the projections 22, the skirt 17 has two threads 25*a*, 25*b* (FIG. 4), intended to cooperate upon treading with the two threads 9*a*, 9*b*, of the neck 7 of the bottle 1. Ihe start of the two threads 25*a*, 25*b*, incorporates an end wall 26*a*, 26*b* (FIG. 4) respectively, these two walls being intended to bear, when screwed down, against the walls 12*a*, 12*b*, respectively, of the end stops 11*a*, 11*b*, associated with each of the threads 9*a*, 9*b*. The threads 25*a*, 25*b* whose upper ends 27*a*, 27*b*, incorporate lead-in sections, are offset by 180° relative to each other and each has a length which is slightly greater than three eighths of a turn.

In addition, the threads 9*a*, 9*b*, 25*a*, 25*b*, are arranged so that, when screwing down is completed, the four outer lateral walls of the device 2 are placed in the extension of each of the outer lateral walls of the bottle 1.

The end wall 18 of the closure device 2 carries internally a cylindrical skirt 28 centered on the axis of the device 2. Several uniformly spaced axial slots 29, six in number, are arranged in the skirt 28 and start from its lower free edge. The skirt 28 carries externally a peripheral rib forming a catching bead 30 having a triangular profile. Furthermore, the outer edge 31 of the skirt 28 is bevelled, advantageously forming with the inner face of the bead 30 the same frustoconical surface.

The applicator device 3 is housed inside the device 2 to which it is integrally connected. The applicator device 3 incorporates a substantially cylindrical stem 32 the lower end 33 of which incorporates an applicator brush 34. In the region of its upper end, the stem 32 widens so as to form a frustoconical outer wall 35, widening in the direction away from the brush 34. This widened region terminates, at its upper end, in an annular collar 36 intended to bear on the edge 15 of the neck 7, in an assembly position of the device 2 on the bottle 1. In addition, the stem 32 has an axial cavity 37 made at its end opposite to that carrying the brush 34, the said cavity 37 having a depth such that its bottom 38 is located at the level of the lower region of the frustoconical wall 35. The collar 36 has, on the side turned towards the brush 34, a seal-bead 39, located substantially at the outer edge of the collar 36, the said seal-bead 39 being intended to bear on the edge 15 of the neck 7.

The outer edge of the collar 36 is joined to a wall 40, made of two parts, namely a first part 41*a*, adjacent to the collar 36, widening in the form of a conical frustum, from the said collar 36 outwards, and a second part 41*b*, of a cylindrical shape and carrying, in the region of its upper end, a peripheral rib forming a catching bead 42 intended to cooperate with the bead 30 carried by the skirt 28 of the closure device 2. Similarly to the bead 30, the bead 42 has a triangular profile such that its inner wall cooperates with the upper wall of the bead 30.

The diameter of the part 41*b*, is such that the outer wall of the said part 41*b*, comes opposite the inner wall 19 of the skirt 17, while being separated slightly from the said wall 19. The outer wall of the part 41*b*, carries, in its upper zone, a peripheral bead 43 located slightly below the inner bead 42, the said bead 43 coming, in position of mounting of the device 3 inside the device 2, to bear against the inner wall 19 of the skirt 17, thus providing locking in rotation of the device 3 relative to the device 2.

It is found that the part 41*a* forms a region capable of being resiliently distorted between the part 41*b* and the collar 36 and that it consequently suffices to calculate the dimensions of the parts 41*a* and 41*b*, in order that, whatever the dimensions of the bottle 1 and the device 2 within the limits permitted as a result of the manufacturing tolerances, at the end of screwing the collar 36 is continually pushed resiliently by the part 41*a* against the edge 15 of the neck 7, the part 41*b* being caught as indicated above, inside the device 2.

Mounting of the applicator device 3 inside the device 2 is very simple, since it suffices to slide the part 41*b* axially inside the device 2 until the bead 42 catches on the bead 30 after resilient distortion of the skirt 28, facilitated by the presence presence of the slots 29. In the assembled position, the bringing of the peripheral bead 43 to bear on the inner wall 19 of the skirt 17 locks the device 3 in rotation relative to the device 2.

The device 2 is then screwed on the neck 7 until, when screwing is complete, the ends 26*a*, 26*b*, of the threads 25*a*, 25*b* come to bear against the corresponding radial faces 12*a*, 12*b*, of the end stops 11*a*, 11*b*, carried by the neck 7, the groove defined by the projections 22 being caught on the bead 8 of the neck 7 by resilient outward distortion of the thinnest lower zone 21 of the skirt 17 of the device 2. This screwing is carried out over a little more than a quarter of a turn. In this position, the collar 36 is pushed resiliently against the edge 15 of the neck 7, the seal-bead 39 bearing on the said edge 15, thus taking up any possible unevenness in the surface of the edge 15.

It is clearly understood that the embodiment described above is not limiting in any manner and can give rise to any desirable modifications without departing thereby from the scope of the invention as defined by the claims.

I claim:

1. In an assembly for the packaging and application of a volatile substance or a substance including volatile components, the said assembly comprising:

(a) a storage container for enclosing the said substance;

(b) a neck to said storage container having a rim;

(c) a removable closure device adapted to be assembled on the storage container;

(d) an applicator adapted to be fixed to the closure device;

(e) a lower part of the applicator adapted to enter the atorage container when the closure device is assembled on the storage container;

(f) a leaktight sealing means to ensure the sealing of the storage container when the closure device, with the applicator fixed thereto, is assembled on said storage container;

the improvement wherein:

(g) the leaktight sealing means comprises a collar integral with the applicator and positioned around an axis that extends through said applicator, said collar abutting the rim of the storage container neck when the closure device is assembled on the storage container and being pressed against that rim by a resilient wall connecting the collar to the closure device, said wall comprising first and second parts, the first part being ajacent to the said collar and capable of being resiliently distorted between the collar and the second part, said second part including first fixing means and the closure device including second fixing means, said first and second fixing means being mutually complementary to fix the closure device to the applicator, and (h) means are provided for ensuring a preselected angular positioning of the closure device on the storage container when said closure device and storage container are assembled together;

said second part of the wall connecting the collar to the closure device being sunstantially perpendicular to said collar; said second part of the wall being cylindrical and having a free edge zone, wherein said closure device incorporates a cylindrical liner wall facing said second wall part in the assembled position at least in the edge zone of the second wall part, and wherein holding means are provided on one of said facing wall surfaces of said closure device and the said second part for holding against the other of said facing wall surfaces and for preventing rotation of the applicator relative to said closure device.

2. An assembly according to claim 1, wherein said first part of the wall connecting the collar to the closure device widens outwardly away from the collar in the form of a conical frustum.

3. An assembly according to claim 1, wherein said first and second fixing means comprise first and second catch-engagement means, and said second part of the wall connecting the collar to the closure device has a free edge with said first catch-engagement means in the region of its free edge.

4. An assembly according to claim 3, wherein said first catch-engagement means consist of a first peripheral catching bead and said second catch-engagement means comprise a second peripheral catching bead carried by the closure device co-operating with said first catch-engagement means, and having a shape complementary therewith.

5. An assembly according to claim 1, wherein the holding means consist of an external peripheral bead of said second wall part and abutting the facing inner wall surface of the closure device.

6. An assembly according to claim 1, including:

a lateral wall to said closure device;

first assembly means on said lateral wall, and complementary corresponding second assembly means carried by the storage container, in order to permits the assembly of the said closure device on said storage container.

7. An assembly according to claim 6, wherein the first and second assembly means consist of first and second complementary thread means carried by the storage container and by the closure device respectively.

8. An assembly according to claim 1, including means for ensuring the angular positioning of the closure device on the storage container when said closure device and storage container are assembled together.

9. An assembly according to claim 7, and including means for ensuring the angular positioning of the closure device on the storage container when said closure device and storage container are assembled together, wherein the means for ensuring the angular positioning of the closure device on the storage container include at least one end stop means carried externally by the storage container below the threaded region of the said storage container, said at least one end stop means being arranged so that when the screwing is completed the end of the associated said second thread means of the closure device situated at the start of the said second thread means bears on the above-mentioned end stop.

10. An assembly according to claim 1, including means for preventing the loosening of the closure device assembled on the storage container.

11. An assembly according to claim 10, wherein said means for preventing the loosening of the closure device assembled on the storage container consist of means defining a retaining groove carried by the inner wall of the closure device and a bead carried by the storage container, said retaining groove being capable of catching on said bead carried by the storage container when assembly is completed.

12. An assembly according to claim 1, wherein the collar ensuring the leaktight sealing on the upper edge of the storage container incorporates a seal-bead intended to bear on the said edge.

13. An assembly according to claim 1, wherein the applicator consists of a stem having a lower end which carries an applicator brush, and wherein the collar which ensures the leaktight sealing on the upper edge of the storage container is carried by the upper end of the said stem.

14. An assembly according to claim 1, wherein the resilient means are carried by a cap forming a connection between the closure device and the applicator the applicator being capable of sliding relative to the cap under the action of the resilient means.

* * * * *